US006371108B1

(12) United States Patent
Christianson

(10) Patent No.: US 6,371,108 B1
(45) Date of Patent: Apr. 16, 2002

(54) DRYEST SNORKEL

(76) Inventor: Tony Christianson, 2007 Wawona Station, Yosemite, CA (US) 95389

( * ) Notice: Subject to any disclaimer, the term of this patent is extended or adjusted under 35 U.S.C. 154(b) by 0 days.

(21) Appl. No.: 09/336,258

(22) Filed: Jun. 18, 1999

(51) Int. Cl.[7] ..... B63C 11/16

(52) U.S. Cl. ..... 128/201.11; 128/200.29; 128/201.26; 128/201.27; 128/201.28; 128/201.29; 128/207.14

(58) Field of Search ..... 128/201.11, 200.29, 128/201.27, 201.28, 207.14, 207.16, 911, 201.26, 201.29; 405/186, 187; 181/127, 21

(56) References Cited

U.S. PATENT DOCUMENTS

| | | | | | |
|---|---|---|---|---|---|
| 4,655,212 | A | * | 4/1987 | Delphia | 128/201.11 |
| 4,805,610 | A | * | 2/1989 | Hunt | 128/201.11 |
| 5,117,817 | A | * | 6/1992 | Lin | 128/201.11 |
| 5,893,362 | A | * | 4/1999 | Evans | 128/201.11 |
| 5,960,791 | A | * | 10/1999 | Winefordner et al. | 128/201.11 |

* cited by examiner

*Primary Examiner*—John G. Weiss
*Assistant Examiner*—Mital Patel

(57) ABSTRACT

The instant invention is a skin diving snorkel having a conduit with an end above the water surface, and an underwater end that terminates in a mouthpiece. The mouthpiece provides a flow path between the conduit and the interior of the diver's mouth. A buoyant chamber, separate from the conduit, surrounds and is coaxial with the conduit above water end. A lower opening in the chamber is joined to the conduit by a convoluted diaphragm. The convoluted diaphragm provides a flexible and watertight barrier that enables the chamber to be easily buoyed a short distance upward, guided by the snorkel conduit. The conduit's open end protrudes loosely through an upper opening in the chamber. The conduit open end carries a flexible circular diaphragm which, when it makes contact with the upper opening of the buoyed chamber, serves as a check valve allowing exhalation flow from the conduit to ambient, but blocks the flow of water into the snorkel. In addition, an optional purge valve adjacent the conduit's underwater end also allows flow from the conduit to ambient, but not in the reverse direction.

15 Claims, 6 Drawing Sheets

DRYEST SNORKEL

The instant application is related to Provisional Application No. 60/132,520 filed May 4, 1999. The instant application is also related to Disclosure Document Number 448590 deposited Dec. 14, 1998.

BACKGROUND OF THE INVENTION

1. Field of the Invention

The present invention is generally related to snorkels used by skin divers and swimmers. More particularly, this invention is concerned with preventing water from entering and flooding a snorkel.

2. Description of the Prior Art

Skin divers and swimmers use the snorkel as a means to breathe while swimming face down on the water surface. The snorkel functions as a conduit between the diver's mouth and the overhead air. Typically, the open end of the snorkel conduit extends a short distance above the water surface. Occasionally, due to swimming movements or wave action, small amounts of water flow or splash into the open end of the snorkel and partially floods the conduit. An experienced skin diver can sense when water enters the snorkel and responds by immediately stopping inhalation. Respiration is resumed after the snorkel has been purged of water. Inexperienced skin divers find occasional flooding especially troublesome because, undetected, water can be inhaled resulting in coughing and extreme discomfort.

Water will also flood the snorkel when the swimmer deliberately dives below the water surface. The snorkel conduit will be completely flooded with water when the swimmer returns to the surface. When the open end of the snorkel is again above the water surface, the flooded conduit is purged for respiration by exhaling an explosive blast of air into the mouthpiece.

Surface tension forms the purging blast of air into a bubble that spans the cross section of the snorkel conduit. Pressure within the bubble expands the bubble toward the open end of the conduit. As the leading surface of the bubble moves away from the mouthpiece, the bulk of the water within the conduit is pushed ahead of the bubble and out the open end.

The purging bubble of air will slip past water that adheres to the inside surface of the conduit. After the purging air bubble is spent, residual water will flow down the inside surface toward the mouthpiece. Also, water which splashes into the open end of the snorkel conduit due to swimming movements or wave action will typically strike and adhere to the inside surface of the conduit and thereafter flow toward the mouthpiece. Water accumulates at the lowermost portion of the snorkel conduit, typically adjacent the mouthpiece, and can soon obstruct the conduit. Unless the conduit is completely blocked, a slow and cautious inhalation is possible after which another purging exhalation can be made.

The respiratory effort needed to purge a snorkel is significant. Many skin divers and swimmers lack the respiratory strength needed to completely purge a flooded snorkel with a single exhalation, and must repeat the purging procedure several times. Also, water will sometimes enter the snorkel just as the swimmer has completed an exhalation, leaving very little air in the lungs to satisfactorily complete a purge.

As a consequence of the difficulties typically encountered by a skin diver or swimmer when trying to purge a flooded snorkel, a number of inventions have been proposed to protect the snorkel opening with devices that prevent water from entering the conduit, even when the swimmer dives underwater.

U.S. Pat. No. 2,317,236 entitled Breathing Apparatus for Swimmers issued to C. H. Wilen, et al, on Apr. 20, 1943, teaches an inverted opening with a caged buoyant ball arranged to block the above water end of the snorkel whenever water starts to enter. Such inverted ball valves are bulky, tend to snag, often fail to seal completely and, also, significantly increase respiratory effort. Although once popular, such devices are now considered unreliable and obsolete.

U.S. Pat. No. 4,071,024 entitled Snorkel, issued to Max A. Blanc on Jan. 31, 1978, teaches an air-entrapping cap which is mounted on the above water opening of the snorkel. A tortuous passage in the cap retards water flow into the snorkel. Although such a cap is somewhat effective in blocking the occasional splash of surface water into the snorkel, it also retards expulsion of water that enters the snorkel during a dive below the water surface. The significant increase in respiratory and purging effort limits its utility and subsequent popularity.

U.S. Pat. No. 4,805,610 entitled Swimmer's Snorkel, issued to Howard Hunt on Feb. 21, 1989, teaches a buoyant cap attached to an internal non-buoyant ball valve which is arranged to block the snorkel opening whenever water covers the cap. As with the valve of Wilen, the Hunt valve is bulky, tends to snag, and does not reliably prevent water from entering the snorkel.

U.S. Pat. No. 5,117,817 entitled Vertical Co-Axial Multi-Tubular Diving Snorkel, issued to Hsin-Nan Lin on Jun. 2, 1992 teaches an annular float arrangement which blocks the above water end of the snorkel whenever water start to enter. To assist in purging, the Lin snorkel also teaches a secondary purge tube within the breathing conduit. The Hsin-Nan Lin snorkel is an improvement over Wilen. However, the valve arrangement of the Hsin-Nan Lin snorkel significantly increases respiratory effort, and if water somehow gets into the snorkel, for example through the mouthpiece, that water is difficult to expel.

Somewhat similar to Blanc, U.S. Pat. No. 5,199,422 entitled Modular Snorkel, issued to Stan Rasocha on Apr. 6, 1993, teaches an exhaust valve mounted on a cap that covers the upper end of the snorkel. The cap restricts the entry of splashed water into the snorkel. The exhaust valve on the cap permits the direct expulsion of water from within the snorkel during a purging exhalation. Although Rasocha's snorkel on an improvement over Blanc, it nevertheless permits water to flood the snorkel when the swimmer dives below the surface.

In view of the foregoing factors, conditions and problems which are characteristic of the prior art, the instant invention was conceived. It is the object of the instant invention to provide a shield that reliably prevents water from entering the open end of a snorkel, but never blocks exhalation flow, does not increase respiratory effort and does not affect the ability of the swimmer to purge the snorkel of water or saliva.

SUMMARY OF THE INVENTION

The instant invention is a skin diving snorkel having a conduit with an end above the water surface, and an underwater end that terminates in a mouthpiece. The mouthpiece provides a flow path between the conduit and the interior of the diver's mouth. A buoyant chamber, separate from the conduit, surrounds and is coaxial with the conduit above water end. A lower opening in the chamber is joined to the conduit by a convoluted diaphragm. The convoluted diaphragm provides a flexible and watertight barrier that enables the chamber to be easily buoyed a short distance upward, guided by the snorkel conduit. The conduit's open end protrudes loosely through an upper opening in the chamber. The conduit open end carries a flexible circular diaphragm which, when it makes contact with the upper opening of the buoyed chamber, serves as a check valve allowing exhalation flow from the conduit to ambient, but blocks the flow of water into the snorkel. In addition, an optional purge valve adjacent the conduit underwater end also allows flow from the conduit to ambient, but not in the reverse direction.

DESCRIPTION OF THE DRAWINGS

A detailed description of the invention is made with reference to the accompanying drawings wherein like numerals designate corresponding parts in the several Figures.

FIG. 13 is a partial longitudinal sectional view of yet another alternate configuration of the inventive snorkel shown with the top open.

FIG. 14 is a partial longitudinal sectional view of the snorkel configuration of FIG. 13, shown with the top closed.

DESCRIPTION OF THE PREFERRED EMBODIMENT

The following detailed description is of the best presently contemplated modes of carrying out the invention. This description is not to be taken in a limiting sense, but is made merely for purposes of illustrating the general principles of the invention.

Figure 1:
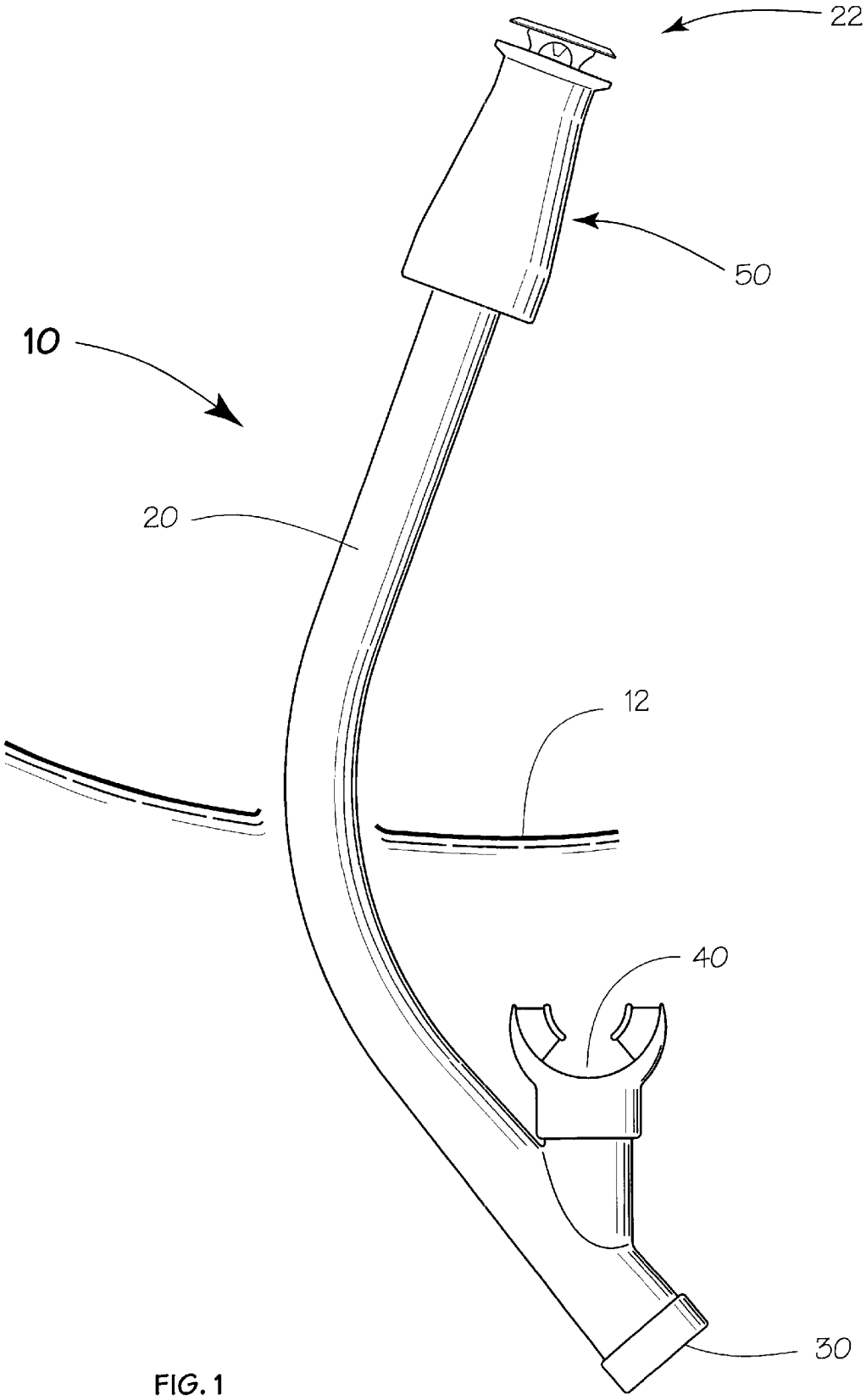
FIG. 1 is a front elevation view of a snorkel which has been constructed in accordance with the principles of the instant invention, pictured in the approximate position of use by a skin diver swimming face down on the water surface.
Figures 2, 3:
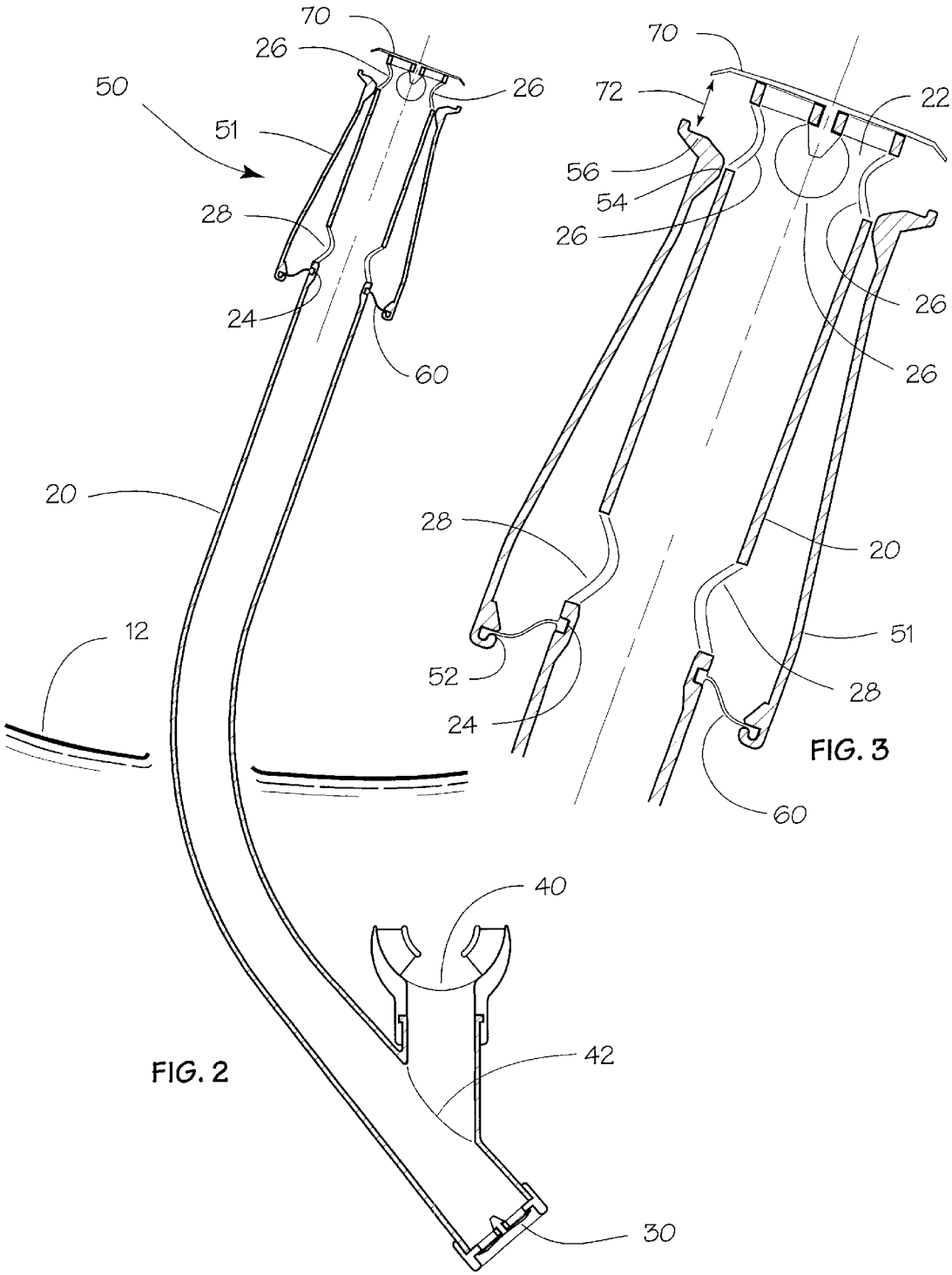
FIG. 2 is a longitudinal sectional view of the snorkel of FIG. 1, shown during respiration.
FIG. 3 is a close-up sectional view of the upper portion of the snorkel of FIG. 2.

Referring to FIGS. 1 and 2, snorkel 10 is pictured in the approximate position of use by a skin diver swimming face down on water surface 12. (For clarity, the skin diver is not shown in the FIGS.) The words "upper" and "lower" or "above the water surface" and "below the water surface" or the like are made with reference to the orientation of snorkel 10 as shown in FIGS. 1 and 2.

Snorkel 10 includes conduit 20 having upper end 22 that extends into the air above ambient water surface 12. The lower end of conduit 20 is optionally closed by purge valve 30. Purge valve 30 is arranged to allow fluid, for example water or saliva, to flow freely from conduit 20 to ambient. Although the preferred configuration includes purge valve 30, the instant invention can be accomplished without purge valve 30 by terminating the underwater end of conduit 20 at mouthpiece 40.

Purge valve 30 is, typically, a flexible diaphragm of a resilient material, for example silicon elastomer or the like, which is restrained in such a way that it can selectively flex under slight pressure to allow flow in one direction only. Reverse pressure forces the diaphragm to seal closed. Consequently, purge valve 30 will prevent the reverse flow of water from ambient into conduit 20.

Mouthpiece 40, above purge valve 30, branches from the side of conduit 20. Mouthpiece 40 is adapted to be held by the mouth of the diver and provides a flow path from conduit 20 to the interior of the mouth. (In the FIGS., the opening of mouthpiece 40 should be considered covered by the diver's mouth.) Shown in FIG. 2, the intersection of mouthpiece 40 with conduit 20 forms an approximately elliptical opening 42.

Conduit 20 is constructed of a rigid or semi-rigid material, for example, vinyl plastic or the like. Conduit 20 is configured to approximately follow the curvature of the diver's head. The upper portion of conduit 20 curves smoothly to place upper end 22 approximately over the center of the head. Alternately, the upper portion of conduit 20 can be straight.

Providing a substantially smooth flow path that is free of abrupt changes in path direction facilitates respiration and purging. While not so limited, the curvature of conduit 20 may, for example, follow an elliptical path around the diver's head.

The upper portion of conduit 20 passes through, and is surrounded by, chamber 50. Chamber 50 is a separate hollow structure defined by the volume contained within sleeve 51 between diaphragm 60 at one end and opening 54 at the other end. Sleeve 51 is coaxial with conduit 20. Sleeve 51 is constructed of a rigid or semi-rigid material, for example, vinyl plastic or the like. Chamber 50 has sufficient volume to be buoyant in water. Although chamber 50 is pictured as having a conical shape, any other shape, for example spherical or cylindrical, or combination of shapes, can be used.

As best shown by FIG. 3, sleeve 51 is joined to conduit 20 by convoluted diaphragm 60. Convoluted diaphragm 60 is firmly attached at its periphery to chamber lower opening 52, and at its center to groove 24 on conduit 20. Convoluted diaphragm 60 is, typically, a flexibly resilient material, for example silicon elastomer or the like, having one or more convolutions. Convoluted diaphragm 60 functions as a flexible and watertight barrier that enables sleeve 51 to easily move axially, guided by conduit 20, a limited distance up and down. Convolutions provide nearly frictionless movement. Convoluted diaphragm 60 can also serve to maintain the axial placement of the lower end of chamber 50 relative to conduit 20.

As an alternative, convoluted diaphragm 60 can be replaced by a sliding seal arrangement, for example a dynamic o-ring seal on a piston. FIGS. 13 and 14 show convoluted diaphragm 60 replaced by O-ring 92 mounted on piston 90. FIGS. 13 and 14 picture sleeve 51 in the down and up positions respectively. Piston 90 functions as a watertight barrier that closes the bottom of sleeve 51. O-ring 92 slides along the outside wall of conduit 20 and maintains a watertight seal. Ring 94 serves as a mechanical stop to limit the downward movement of piston 90. Any arrangement that provides a leakproof or watertight barrier, and allows axial movement of sleeve 51, can be incorporated. However, sliding o-rings or the like typically resist starting movement, and continued movement generates friction. Consequently, the preferred configuration of the instant invention incorporates a convoluted diaphragm because a convoluted diaphragm will function with little, if any, resistance to movement of sleeve 51.

When chamber 50 is entirely out of the water, the weight of chamber 50 causes it to drop downward, guided by conduit 20. FIG. 2 and close-up FIG. 3 show chamber 50 at its lowermost position. When water travels up snorkel 10 and starts to submerge chamber 50, for example, due to wave action or a deliberate diving action by the swimmer, the water will buoy chamber 50 upward.

Figure 4:
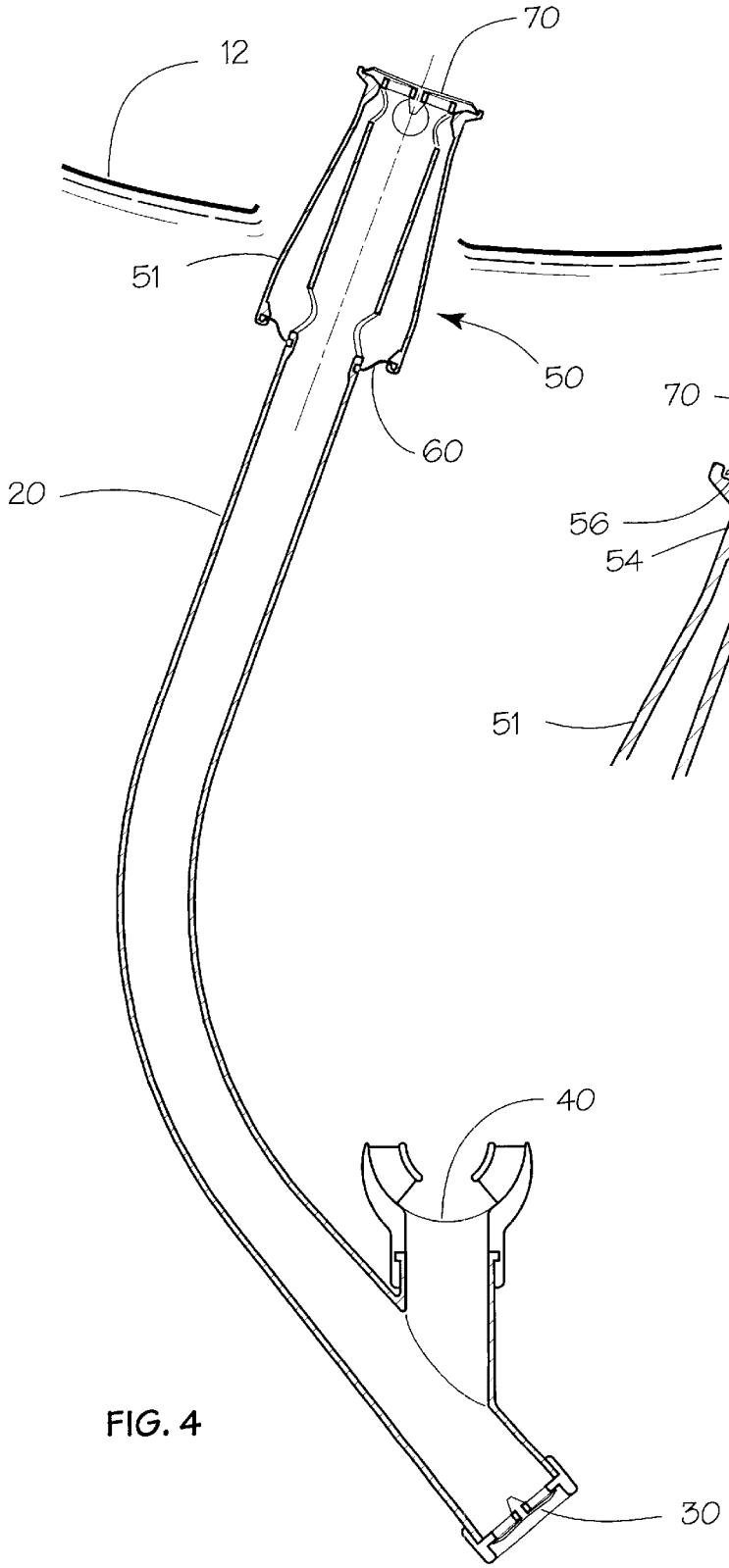
FIG. 4 is a view similar to FIG. 2, showing the snorkel nearly submerged.
Figure 5:
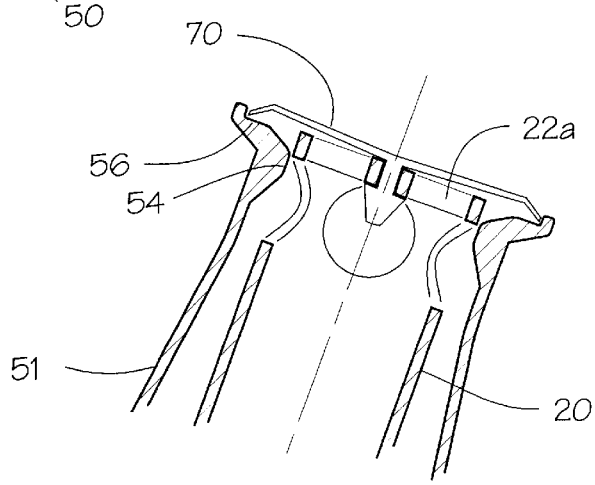
FIG. 5 is a close-up sectional view of the upper portion of the snorkel of FIG. 4.

FIG. 4 and close-up FIG. 5 shows chamber 50 buoyed upward as a result of snorkel 10 being nearly submerged. Advantageously, the volume of chamber 50 is chosen so that it will be buoyed fully upward before it is completely submerged. However, an overly large chamber 50 will be bulky and unwieldy. Consequently, the size of chamber 50 is a compromise that provides adequate buoyancy but not excess bulk.

Conduit upper end 22 protrudes loosely through upper opening 54 of chamber 50. The loose fit between conduit 20 and opening 54 enables chamber 50 to easily slide along, and be guided by, conduit 20.

Conduit upper end 22 carries circular diaphragm 70. As best seen in FIG. 3, when chamber 50 is at its lowermost position, circular diaphragm 70 is separated from upper opening 54 and air can freely pass through cylindrical opening 72 formed by the clearance between circular diaphragm 70 and opening 54. Openings 26 in the side of conduit 20 adjacent upper end 22 and circular diaphragm 70 facilitate fluid flow into and out of conduit 20 through cylindrical opening 72.

Figure 8:
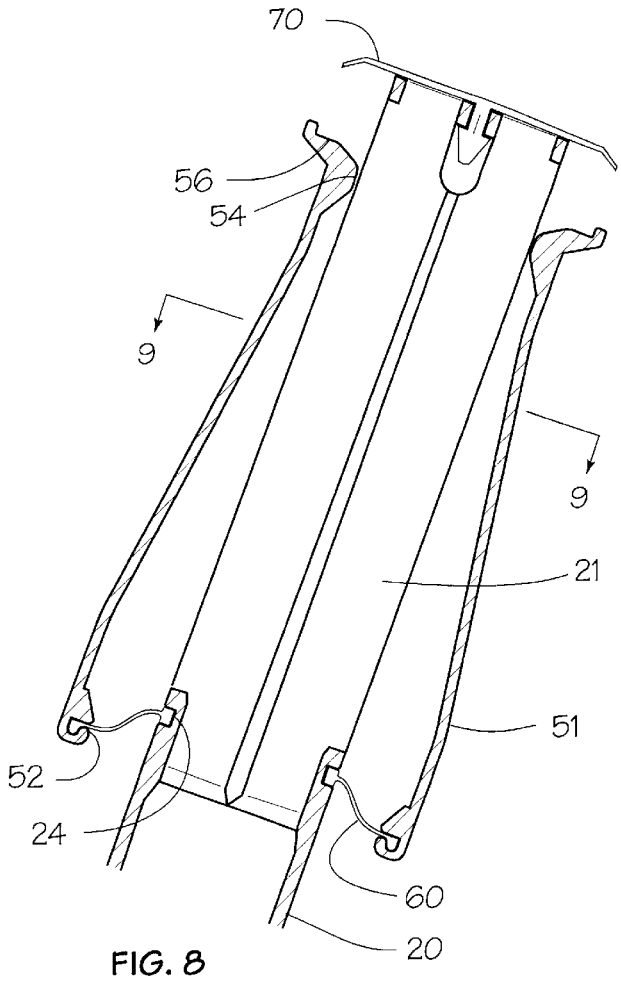
FIG. 8 is a partial longitudinal sectional view of an alternate configuration of the inventive snorkel.
Figure 9:
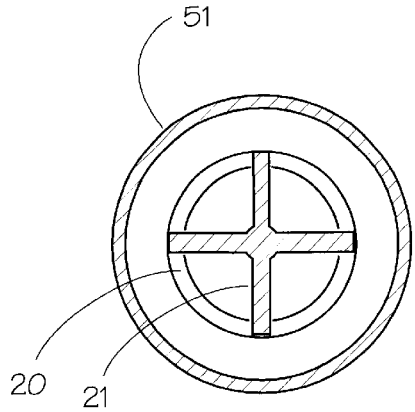
FIG. 9 is a sectional view of the inventive snorkel of FIG. 8 taken along a plane corresponding to line 9—9 of FIG. 8.

FIG. 8 shows an alternate configuration in which the upper end of conduit 20 terminates adjacent convoluted diaphragm 60 and extension 21 supports circular diaphragm 70. Extension 21 is an open structure having a cross or similar section (as shown in FIG. 9) that is attached to conduit 20. Extension 21 also serves to guide the movement of chamber 50.

Advantageously sized larger than chamber upper opening 54, circular diaphragm 70 also serves as a cap or umbrella that deflects any water dropping from overhead, for example splashed water.

Figure 10:
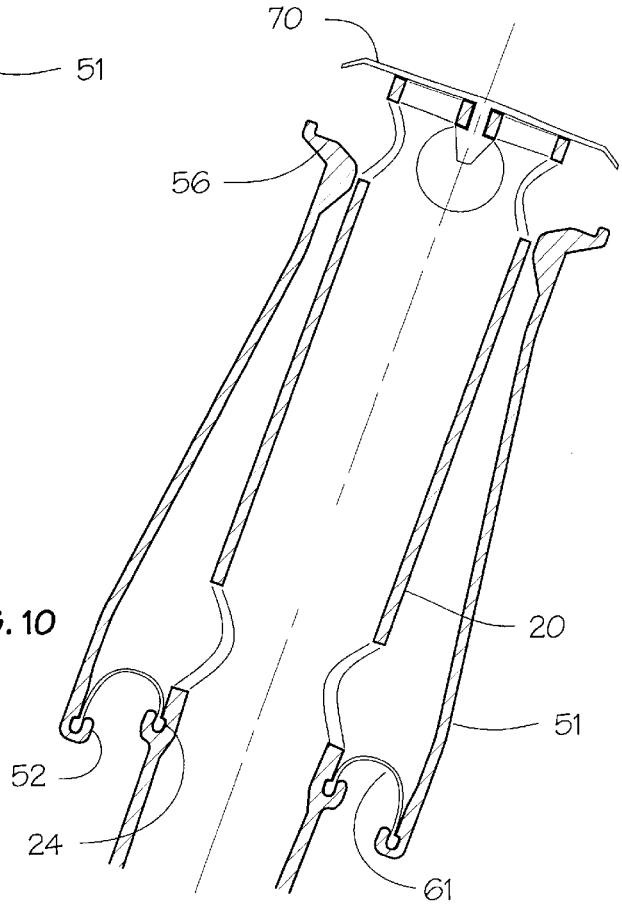
FIG. 10 is a partial longitudinal sectional view of another alternate configuration of the inventive snorkel.

The physical size, shape and flexibility of convoluted diaphragm 60 determine the distance of travel of sleeve 51. For example, FIG. 3 shows convoluted diaphragm 60 as having a shallow conical shape with a large radius convolution that provides a relatively short range of axial movement. FIG. 10 shows an alternate configuration in which convoluted diaphragm 61 has a deep rolling small radius convolution that provides a much greater range of movement.

Cylindrical opening 72 defines a flow area. The area of cylindrical opening 72 needed to provide unrestricted respiratory flow determines the optimum distance of travel for sleeve 51. Depending on the size of convoluted diaphragm 61, appropriate movement limiting stops may be required.

As seen in FIGS. 4 and 5, when chamber 50 is buoyed upward, the peripheral edge of circular diaphragm 70 will make contact with shelf 56 adjacent upper opening 54 of chamber 50. Shelf 56 is a substantially smooth annular surface that serves as a seat for circular diaphragm 70. When in contact with shelf 56, circular diaphragm 70 functions as a check valve that selectively allows one-way flow from conduit 20 to ambient, but rot the reverse.

Circular diaphragm 70 is, typically, a flexible diaphragm of a resilient material, for example silicon elastomer or the like, which is attached to conduit upper end 22 in such a way that it can selectively flex outward under slight pressure. Structure **22*a* of conduit upper end 22 supports circular diaphragm 70 and prevents circular diaphragm 70 from flexing inward. When functioning as a check valve, ambient pressure forces circular diaphragm 70 against the seat provided by chamber shelf 56, thereby preventing the flow of ambient water into conduit 20. The words "the closed position" or the like are made with reference to the position of chamber 50 as shown in FIGS. 4 and 5**.

When chamber 50 is partially or completely submerged, for example due to wave action or when the swimmer deliberately dives below the water surface, buoyant force will lift chamber 50 until circular diaphragm 70 makes contact with shelf 56, thereby preventing water from entering conduit 20. If upward movement of chamber 50 occurs while the swimmer is inhaling, inhalation flow will be automatically and instantly blocked to prevent the undesirable entry of water into conduit 20. If upward movement of chamber 50 occurs while the swimmer is exhaling, the pressure of exhalation will flex circular diaphragm 70 outward thereby allowing the exhaled gases to escape, which also prevents water from entering conduit 20. Any subsequent inhalation will be blocked until chamber 50 is once again above the water.

If the swimmer removes mouthpiece 40 from the mouth while in the water, for example to talk, snorkel 10 will often be at least partially flooded when the swimmer returns mouthpiece 40 to the mouth for additional use. Similarly, if the swimmer enters the water without mouthpiece 40 already in the mouth, snorkel 10 will often be at least partially flooded when the swimmer first puts mouthpiece 40 in the mouth. In addition, saliva from the mouth can drain into conduit 20 and accumulate below mouthpiece 40.

Water and saliva in conduit 20 is purged by forcefully exhaling air into mouthpiece 40. Surface tension forms the exhaled air into a bubble which expands upward in conduit 20. As the leading surface of the bubble moves away from mouthpiece 40, the bulk of the water within conduit 20 is pushed ahead of the bubble and out cylindrical opening 72.

As best seen in FIG. 3, openings 28 in conduit 20 adjacent groove 24 facilitate the drainage of water that accumulates in the interior annular volume of chamber 50 external to conduit 20. Because extension 21 is fully open to the interior of chamber 50, neither openings 26 nor openings 28 are needed in the configuration of FIG. 8.

In the event that chamber 50 moves upward (due, for example, to wave action) during the purging exhalation, cylindrical opening 72 will close, but purging action will continue because circular diaphragm 70 will flex outward, away from shelf 56, and allow the water inside conduit 20 to escape. Consequently, inventive snorkel 10 does not interfere with a purging exhalation even when conduit upper end 22 is nearly or completely underwater.

When optional purge valve 30 is provided, a forceful exhalation will also expand downward, forcing fluid below mouthpiece 40 to flow to ambient through purge valve 30. The outflow of water will flex purge valve 30 outward. Consequently, a purging exhalation forces water within conduit 20 to be cleared both above and below mouthpiece 40.

The volume of the portion of conduit 20 between mouthpiece 40 and purge valve 30 is advantageously sized to hold, away from the respiratory flow path, saliva or any residual water that remains after a purging exhalation. Empirical studies have determined that a volume equivalent to ten percent (10%) of the snorkel's total internal volume is sufficient for this purpose.

Chamber 50 is subjected to a number of forces depending on whether the chamber is out of the water, is partially submerged in the water, or is completely underwater. When entirely out of the water, the force of gravity moves chamber 50 downward, thereby opening conduit end 22 for unrestricted respiratory flow. When partially submerged, chamber 50 moves upward because ambient water pressure against convoluted diaphragm 60 and the submerged portion of chamber 50 will provide lifting forces that overcomes the gravitational force, thereby closing conduit end 22. When chamber 50 is completely underwater, pressure forces directed to the top, sides and bottom combine to maintain chamber 50 at the closed position.

When a swimmer dives below the water surface a snorkel 10 is completely submerged, chamber 50 will have moved upward, thereby closing the snorkel's upper end 22. As the diver continues to swim below the water surface and looks around, the orientation of snorkel 10 will not necessarily remain upright as depicted in FIGS. 1 and 2. Head movements will change the orientation of snorkel 10. For example, snorkel 10 will be completely inverted relative to the water surface when the swimmer is looking directly upward.

Figure 6:
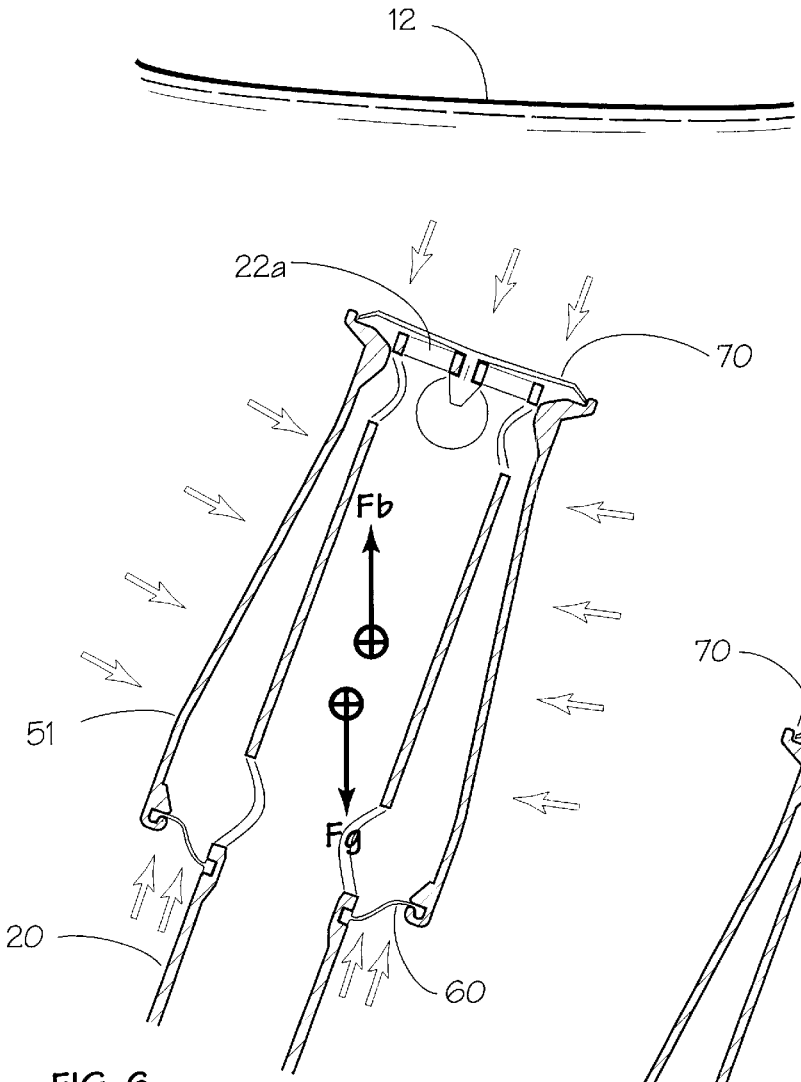
FIG. 6 is a close-up sectional view of the upper portion of the snorkel of FIG. 4, but with the snorkel completely underwater.

When snorkel 10 is underwater, it is crucial that the net force acting on chamber 50 be directed to hold chamber 50 at the closed position, no matter what the orientation of snorkel 10. As shown in FIG. 6, when snorkel 10 is completely underwater, the buoyant force due to displaced water will oppose the gravitational force (depicted as Fb and Fg, respectively.) In addition, ambient water pressure (depicted as small outline arrows) will act against circular diaphragm 70, convoluted diaphragm 60, and the walls of chamber 60 and conduit 20.

When a swimmer first dives underwater, ambient water pressure against convoluted diaphragm 60 and the submerged portion of chamber 50 provides the force that lifts chamber 50 upward. When snorkel 10 is fully submerged ambient pressure forces diaphragm 70 firmly against shelf 56 of chamber 50. However, if diaphragm 70 is not sufficiently supported by conduit end 22, ambient pressure will flex diaphragm 70 toward chamber 50, forcing chamber 50 to move out of firm sealing contact with the periphery of diaphragm 70. Furthermore, inward flexing of circular diaphragm 70 will tend to distort or warp its peripheral edge, which will break the watertight seal with shelf 56. Consequently, structure 22*a* must provide sufficient support to counteract ambient pressure against circular diaphragm 70.

Underwater, the pressure inside snorkel 10 can never be greater than ambient because excess pressure will be vented through the check valve action of diaphragm 70 or, when snorkel 10 is inverted, purge valve 30. The ambient pressure at the depth of diaphragm 70, or purge valve 30 when snorkel 10 is inverted, will determine the maximum pressure inside conduit 20. As the swimmer dives deeper, ambient pressure against the lungs will maintain the respiratory tract at or near ambient pressure. Although instinctively the swimmer will stop breathing when underwater, and may plug mouthpiece 40 with the tongue, the pressure of the respiratory tract will involuntarily bleed through mouthpiece 40 into conduit 20. However, unless the swimmer deliberately exhales into snorkel 10 as the depth increases, the pressure inside snorkel 10 will be somewhat less than ambient. The slightly lower pressure inside chamber 50 with respect to ambient pressure is used by the instant invention to keep chamber 50 at the closed position, no matter what the orientation of snorkel 10.

Ambient pressure acts normal to the surface of an unsupported diaphragm segment. Consider that conduit 20 is oriented so that its axis is vertical, the force vectors normal the diaphragm surface can be replaced by their horizontal and vertical components. The horizontal components acting in opposition cancel out each other. The sum of the vertical components adds up to the total pressure force and is equal to the normal pressure on a projection of the unsupported segment. The total pressure force is shared by the inside and outside attachments or supports of the diaphragm. Consequently, the effective pressure area is defined by a diameter approximately midway between the diameters of the inner and outer supports. The precise effective pressure area is determined by the relative elevations of the supports, the size and shape of the convolution and the relative diameters of the inside and outside supports.

Figure 7:
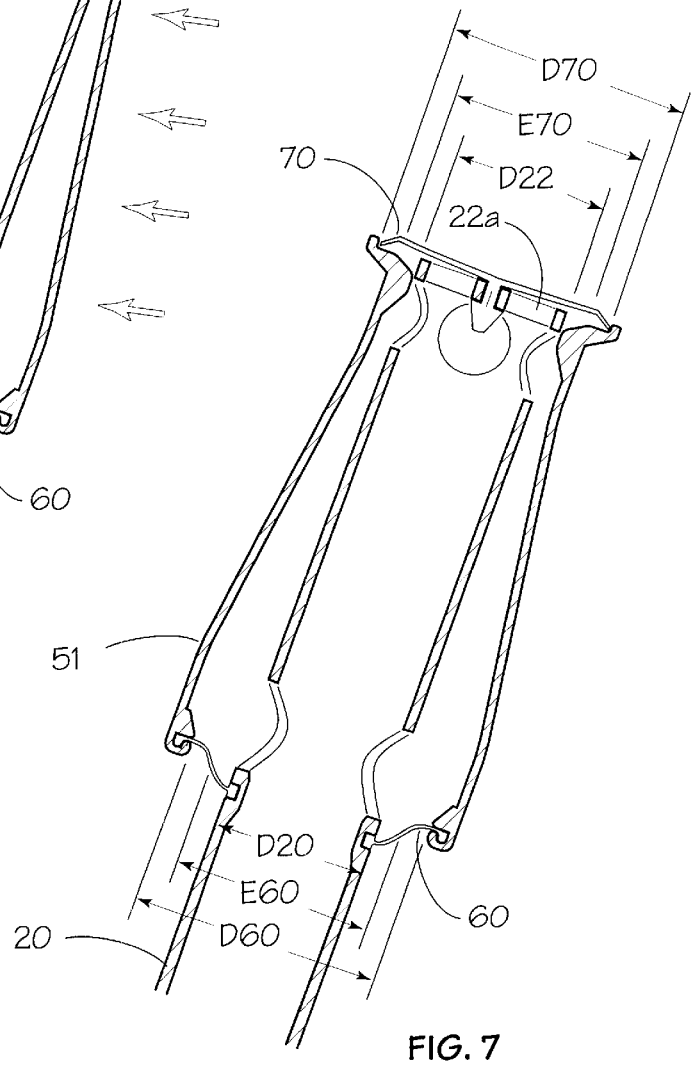
FIG. 7 is another close-up sectional view similar to FIG. 6.

By properly adjusting the effective pressure areas of circular diaphragm 70 and convoluted diaphragm 60 in relation to the buoyant and gravitational forces, the net force will be directed to hold chamber 50 at its closed position, no matter what the orientation of snorkel 10. As shown in FIG. 7, the effective pressure area E60 of convoluted diaphragm 60 is defined by diameters D20 and D60. Similarly, the effective pressure area E70 of circular diaphragm 70 is defined by the diameters D22 and D70. The buoyant force acting on chamber 50 is defined by the amount of water displaced by the volume of chamber 50 external to conduit 20. The force due to gravity is defined by the weight of the materials used to construct chamber 50. To maintain the closed position when chamber 50 is completely underwater, and taking advantage of a slight negative pressure inside chamber 50 relative to ambient, effective area E70 of circular diaphragm 70 must be greater than effective area E60 of convoluted diaphragm 60.

When snorkel 10 is inverted underwater, for example due to the swimmer looking upward, the pressure inside conduit 20 can be no greater than the ambient pressure at the depth of purge valve 30. Under such conditions, chamber 50 is at a 6depth greater than purge valve 30, and the pressure inside chamber 50 will always be less than ambient. Furthermore, when snorkel 10 is inverted, the buoyant force is working to move chamber 50 away from the closed position, but the gravitational force is working to hold the closed position. Therefore, for chamber 50 to remain at the closed position even when snorkel 10 is inverted, the net pressure force plus gravitational force must be greater than the buoyant force. The preferred configuration includes purge valve 30 because purge valve 30 provides the benefit of maintaining the pressure inside chamber 50 less than ambient when snorkel 10 is inverted underwater.

Figure 11:
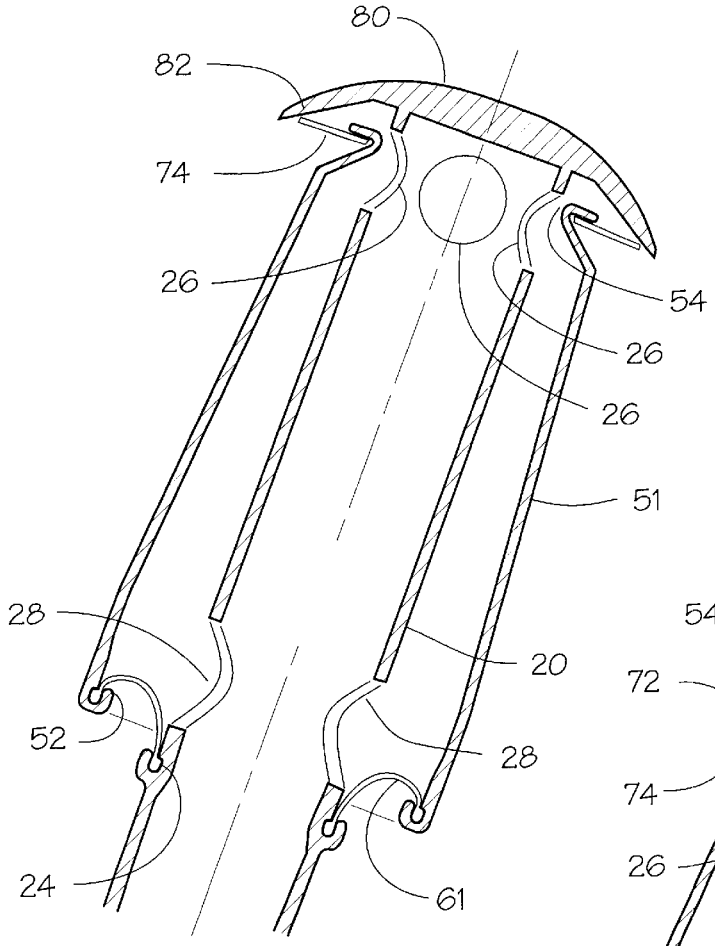
FIG. 11 is a partial longitudinal sectional view of yet another alternate configuration of the inventive snorkel shown with the top closed.
Figure 12:
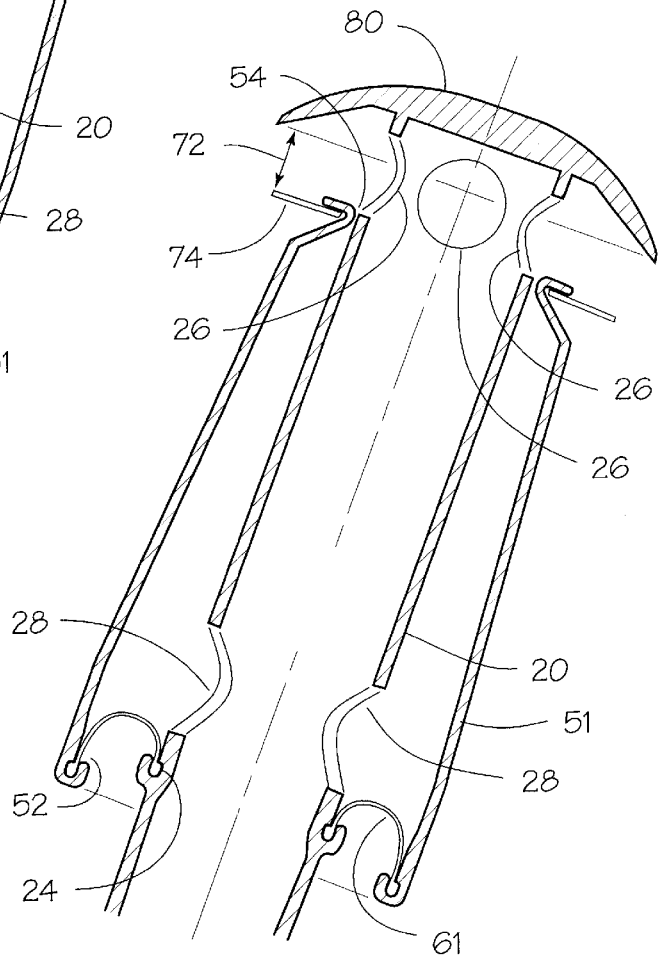
FIG. 12 is a partial longitudinal sectional view of the snorkel configuration of FIG. 11, shown with the top open.

FIGS. 11 and 12 show an alternate configuration in which annular diaphragm 74 is carried by chamber 50 adjacent opening 54. Cap 80 closes the upper end of conduit 20. As shown in FIG. 11, when chamber 50 is buoyed upward, the peripheral edge of annular diaphragm 74 will make contact with conical surface 82 of cap 80. Annular diaphragm 74 and conical surface 82 function identically to circular diaphragm 70 and chamber shelf 56, respectively, but their positions have been reversed. Furthermore, extension 21 of the inventive snorkel configuration of FIG. 8 can be incorporated into the configuration of FIGS. 11 and 12.

Annular diaphragm 74 is, typically, a flexible ring of a resilient material, for example silicon elastomer or the like, which is attached adjacent to chamber opening 54 in such a way that it can selectively flex downward under slight pressure. Conical surface 82 and the attaching flange adjacent opening 54 support annular diaphragm 74 when chamber 50 is at the closed position. When functioning as a check valve, ambient water pressure forces annular diaphragm 74 to seal closed against conical surface 82, preventing the flow of water from ambient into conduit 20.

In the event that chamber 50 moves upward (due, for example, to wave action) during a purging exhalation, cylindrical opening 72 will close, but purging action will continue because annular diaphragm 74 will flex downward, away from conical surface 82, and allow the water inside conduit 20 to escape. Similarly, when chamber 50 is at the closed position, annular diaphragm 74 will flex open during a respiratory exhalation, but will block an inhalation.

The outside edge of cap 80 is advantageously sized larger than the peripheral edge of annular diaphragm 74. Consequently, cap 80 also serves as an umbrella that deflects water dropping from overhead, for example splashed water. Furthermore, extending the outside edge of cap 80 downward past annular diaphragm 74 can provide additional splash protection. However, any extension of cap 80 past annular diaphragm 74 must incorporate sufficient clearance or openings to allow unrestricted respiration through cylindrical opening 72.

Other variations on the, diameter, cross-section shape and radius of curvature of conduit 20; size and shape of chamber 50; size, shape and location of convoluted diaphragm 60 on conduit 20; number of convolutions on diaphragm 60; mounting of either circular diaphragm 70 or annular diaphragm 74; and various methods to adjust the mouthpiece location and orientation relative to the conduit, are contemplated.

It is understood that those skilled in the art may conceive of modifications and/or changes to the invention described above. Any such modifications or change that fall within the purview of the description are intended to be included therein as well. This description is intended to be illustrative and is not intended to be limiting. The scope of the invention is limited only by the scope of the claims appended hereto.

I claim:

1. A snorkel device comprising:

a conduit adapted to extend above the water surface when carried by a swimmer;

said conduit having first and second ends thereof;

said conduit first end having at least one opening adapted to admit ambient fluid into said conduit;

mouthpiece joined to said conduit second end for communicating fluid flow with said conduit, a sleeve surrounding a portion of said conduit adjacent said conduit first end, said sleeve having first and second ends, said sleeve adapted to move relative to said conduit;

said sleeve first end is joined to said conduit by a watertight barrier; said watertight barrier adapted to allow watertight movement of said sleeve; and a sealing means adjacent said sleeve second end, said sealing means substantially prevents the flow of ambient fluid into said conduit when at least a portion of said sleeve is underwater.

2. The snorkel device recited in claim 1 wherein:

said sleeve is substantially coaxial with said conduits; and movement of said sleeve is guided by said watertight barrier.

3. The snorkel device recited in claim 1 wherein:

said watertight barrier is a flexible diaphragm.

4. The snorkel device recited in claim 1 wherein:

said sealing means includes a valve and seat arranged to selectively prevent the flow of ambient fluid into said conduit when at least a portion of said sleeve is underwater.

5. The snorkel device recited in claim 4 wherein:

said valve is a diaphragm.

6. The snorkel device recited in claim 4 wherein:

said valve is carried by said conduit first end; and said seat is carried by said sleeve second opening.

7. The snorkel device recited in claim 4 wherein:

said valve is carried by said sleeve second opening; and said seat is carried by said conduit first end.

8. The snorkel device recited in claim 1 including:

a purge valve adjacent said conduit second end, said purge valve arranged to selectively provide unidirectional flow from said conduit to ambient.

9. A snorkel device for swimmers comprising:

a conduit having first and second ends thereof;

said conduit first end having at least one opening adapted to admit ambient fluid into said conduit;

mouthpiece joined to said conduit second end for communicating fluid flow with said conduit;

an outer structure defining a buoyant chamber that surrounds at least a portion of said conduit; said chamber adapted to move relative to said conduit; said chamber having first and second openings thereof; said conduit passes through said chamber first opening;

a flexible diaphragm joining said chamber first opening to said conduit; said flexible diaphragm adapted to provide watertight movement of said buoyant chamber; and a valve situated between said conduit first open end and said chamber second opening; said valve substantially prevents the flow of ambient fluid into said conduit first end when said chamber is buoyed by water.

10. The snorkel device recited in claim 9 wherein:

said valve selectively provides unidirectional fluid flow from said conduit to ambient when said chamber is buoyed by water.

11. The snorkel device recited in claim 9 including:

purge valve adjacent said conduit second open end, said purge valve arranged to selectively provide unidirectional flow from said conduit to ambient.

12. A snorkel device comprising:

a conduit having first and second ends thereof;

said first end of the conduit having a cap and at least one opening near the cap;

the conduit adapted to extend above the water surface when carried by a swimmer;

said first end of the conduit adapted to admit ambient fluid into the conduit via the at least one opening;

a mouthpiece joined to the second end of the conduit for communicating fluid flow with the conduit;

an outer sleeve having a first open end and second open end that surrounds a portion of the conduit adapted to extend above the water surface; said second open end of the outer sleeve joined to the conduit by a flexible diaphragm; said first open end of the outer sleeve having a shelf to receive the cap of the conduit;

said outer sleeve being movable to a closed position when acted upon by buoyant force, wherein said closed position is defined by the cap sealingly resting on the shelf to prevent ambient fluid from flowing into said conduit; and said outer sleeve being movable to an open position when the outer sleeve is above the water surface, wherein said open position is defined by the cap being separated from the shelf.

13. The snorkel device recited in claim 12 including:

purge valve adjacent said conduit second end, said purge valve arranged to selectively provide unidirectional flow from said conduit to ambient.

14. The snorkel device recited in claim 13 wherein:

said flexible diaphragm defines a first effective pressure area; said valve defines a second effective pressure area; and said second effective pressure area is at least equal to said first effective pressure area.

15. The snorkel device recited in claim 14 wherein:

gravitational and buoyant forces act on said chamber;

the force due to gravity and ambient water pressure against said first and second effective pressure areas define a combined force;

said combined force is greater than the buoyant force when said snorkel device is inverted underwater.

* * * * *